US006684661B1

(12) United States Patent
Beasley et al.

(10) Patent No.: US 6,684,661 B1
(45) Date of Patent: Feb. 3, 2004

(54) RECEIVER DRYER MOUNTING BRACKET FOR A CONDENSER SYSTEM

(75) Inventors: Marvin D. Beasley, West Bloomfield, MI (US); Terry G. Reavis, Fayetteville, TN (US); James D. Snow, Tullahoma, TN (US); Norimitsu Takeshita, Commerce Township, MI (US)

(73) Assignee: Calsonic Kansei North America, Inc., Farmington Hills, MI (US)

( * ) Notice: Subject to any disclaimer, the term of this patent is extended or adjusted under 35 U.S.C. 154(b) by 0 days.

(21) Appl. No.: 10/410,810

(22) Filed: Apr. 10, 2003

Related U.S. Application Data

(63) Continuation of application No. 10/256,686, filed on Sep. 26, 2002, now Pat. No. 6,578,371.

(51) Int. Cl.[7] ..... F25B 43/00
(52) U.S. Cl. ..... 62/474; 62/509
(58) Field of Search ..... 62/474, 298, 503, 62/509, 77

(56) References Cited

U.S. PATENT DOCUMENTS

| | | | | |
|---|---|---|---|---|
| 5,240,068 A | | 8/1993 | Tokutake | |
| 5,394,710 A | * | 3/1995 | Matsuo et al. | 62/509 |
| 5,546,761 A | * | 8/1996 | Matsuo et al. | 62/509 |
| 5,570,737 A | * | 11/1996 | Tokutake | 165/67 |
| 5,628,206 A | | 5/1997 | Baba | |
| 5,666,791 A | | 9/1997 | Burk | |
| 5,685,364 A | | 11/1997 | Harris | |
| 5,709,106 A | | 1/1998 | Inaba et al. | |
| 5,713,217 A | | 2/1998 | Baba | |
| 5,868,002 A | * | 2/1999 | Matsubayashi | 62/507 |
| 5,884,503 A | | 3/1999 | Inaba | |
| 5,899,263 A | * | 5/1999 | Tokutake | 165/67 |
| 5,947,196 A | * | 9/1999 | Halm et al. | 165/173 |
| 6,052,899 A | | 4/2000 | Inaba | |
| 6,223,556 B1 | | 5/2001 | DeKeuster et al. | |
| 6,301,926 B1 | | 10/2001 | Avequin et al. | |
| 6,330,810 B1 | | 12/2001 | Yamazaki et al. | |
| 6,357,256 B1 | | 3/2002 | Mallek | |
| 6,397,627 B1 | | 6/2002 | Aki et al. | |
| 6,468,334 B2 | | 10/2002 | Incorvia et al. | |
| 6,477,858 B2 | | 11/2002 | Nobuta et al. | |
| 6,505,481 B2 | | 1/2003 | Neumann et al. | |

FOREIGN PATENT DOCUMENTS

JP 409303906 A * 11/1997

* cited by examiner

*Primary Examiner*—William C. Doerrler
*Assistant Examiner*—Mohammad M. Ali
(74) *Attorney, Agent, or Firm*—Jordan M. Meschkow; Lowell W. Gresham; Meschkow & Gresham PLC

(57) ABSTRACT

A receiver dryer mounting bracket (38) for a condenser system (20) includes a body (76) and an arm (78) coupled to and extending from the body (76). The body (76) has an opening (90) and seat sections (92, 94) positioned at opposing ends of a length of the opening (90). Flanges (71, 73) on inlet and outlet pipes (34, 36) of the condenser system (20) are seated in the seat sections (92, 94). An arcuate crimp section (102) of the body (76) is compressed to secure the inlet and outlet pipes (34, 36) in respective ones of the seat sections (92, 94) to form a pipe assembly (30). The pipe assembly (30) is coupled to a header (26) of the condenser system (20) prior to furnace brazing, and a receiver dryer (32) is subsequently mounted to the bracket (38).

20 Claims, 4 Drawing Sheets

RECEIVER DRYER MOUNTING BRACKET FOR A CONDENSER SYSTEM

RELATED INVENTION

Continuation of prior application Ser. No. 10/256,686 filed Sep. 26, 2002 now U.S. Pat. No. 6,578,371.

TECHNICAL FIELD OF THE INVENTION

The present invention relates to the field of air conditioning systems. More specifically, the present invention relates to a bracket for a receiver dryer of a sub-cooled condenser system.

BACKGROUND OF THE INVENTION

In a conventional vapor compression system, vapor refrigerant is compressed in the compressor, where its temperature is raised above the temperature of the cooling medium used at the condenser. A mixture of vapor and liquid refrigerant then enters the condenser where heat is extracted, and the refrigerant changes to a liquid. The liquid refrigerant then enters the thermal expansion valve, which controls the quantity of liquid refrigerant passing to the evaporator coils. Finally, the liquid refrigerant enters the evaporator and evaporates. Heat from the ambient atmosphere, for example, in a vehicle passenger compartment, is rejected to the refrigerant in the evaporator where it is absorbed as the latent heat of vaporization as the refrigerant evaporates. The now vaporized refrigerant is then directed to the compressor to be recycled through the system.

Some vapor compression systems include a receiver dryer which is intended to perform some or all of the following functions: filtration and/or dehydration of the refrigerant, compensation for variations in its volume, and separation of the vapor and liquid phases of the refrigerant. Typically, an inlet pipe is coupled between an upstream section of the condenser and an inlet port of the receiver for carrying the vapor and liquid phases of the refrigerant to the receiver dryer. An outlet pipe is coupled between an outlet port of the receiver and a downstream section of the condenser header for returning the liquid phase of the refrigerant to the downstream section. Interposing the receiver dryer between upstream and downstream sections of the condenser ensures the fluid in the downstream section circulates only in the liquid state. The downstream section, or sub-cooler section, of the condenser sub-cools the liquid refrigerant to a point below the temperature at which the liquid changes to a gas. The sub-cooled liquid phase refrigerant quality is low and its enthalpy is also low which increases the evaporator's ability to absorb heat as the refrigerant evaporates, thus improving the efficiency of the vapor compression system.

Condenser systems used in vehicle air conditioning systems are typically manufactured by first assembling brazing clad condenser components together, then passing the assembled components through a brazing furnace to braze, or fuse, the components together. Typically, one or more brackets are used to mount the receiver dryer, inlet pipe, and outlet pipe to a header of the condenser. The bracket or brackets may be first bolted or tack welded to the header prior to the brazing process. Bolting and tack welding prior to brazing is typically performed manually, thus resulting in undesirable labor costs for the manufacturing process.

In addition, some mounting brackets are assembled using a number of discrete components. An undesirably high number of discrete components increases the likelihood that the condenser system may be misassembled, and increases the potential for damaging the inlet and outlet pipes coupled between the condenser and the receiver dryer. Other prior art designs utilize large connector blocks for mounting the receiver dryer to the condenser header. These large connector blocks have greater mass, thus making the brazing process more difficult.

When a receiver dryer is included in a condenser system, it is often desirable to service the receiver dryer one or more times during the useable life of the condenser by replacing, replenishing, or refurbishing the desiccant inside the receiver dryer. The prior art vapor refrigeration systems, having mounting brackets of multiple discrete components, increases the duration and complexity of service performed on the receiver dryer, again resulting in undesirable labor costs. Thus, what is needed is a receiver dryer mounting bracket that enables simple, secure, and convenient fixation of the receiver dryer to the header.

SUMMARY OF THE INVENTION

Accordingly, it is an advantage of the present invention that a receiver dryer mounting bracket for a condenser system is provided.

It is another advantage of the present invention that a receiver dryer mounting bracket is provided that facilitates pre-assembly of the inlet and outlet pipes with the mounting bracket prior to brazing.

Another advantage of the present invention is that the receiver dryer mounting bracket provides a secure mount for the receiver dryer and promotes the correct connection of the receiver dryer to the condenser.

Yet another advantage of the present invention is that a receiver dryer mounting bracket is provided that enables rapid and simple servicing of the receiver dryer.

The above and other advantages of the present invention are carried out in one form by a bracket for use in a condenser system. The condenser system has two spaced apart headers, a plurality of parallel tubes extending between the headers for passing refrigerant between the headers, and a receiver dryer. An inlet pipe is coupled to one of the headers and an inlet port of the receiver dryer. An outlet pipe is coupled to the one of the headers and an outlet port of the receiver dryer. The bracket retains the inlet and outlet pipes in fixed relation with the one of the headers. The bracket comprises a body including a first surface, a second surface, and a side spanning a width of the body from the first surface to the second surface. The body has an opening extending through the body configured for passage of the inlet and outlet pipes. The first surface has first and second seat sections at the opening, the first seat section being configured for retention of the inlet pipe, and the second seat section being configured for retention of the outlet pipe. An arm is coupled to and extends from the side of the body. The arm has a concave surface for mating engagement with the one of the header tubes.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
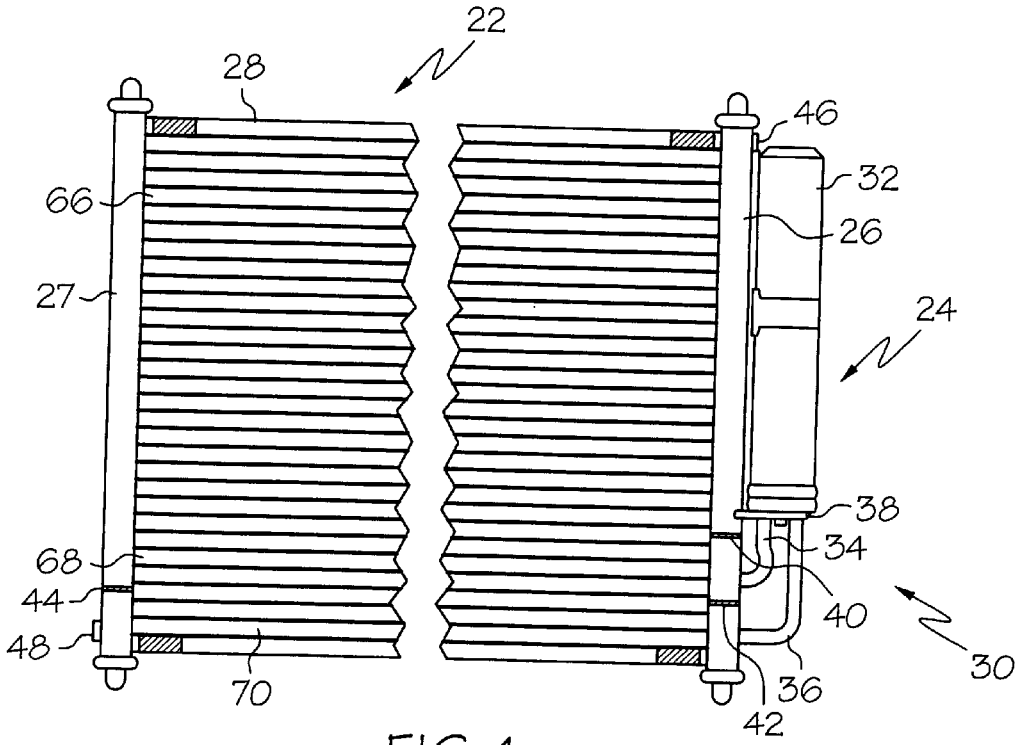
FIG. 1 shows a side view of a condenser system for a vapor compression system.

FIG. 1 shows a side view of a condenser system 20 for a vapor compression system (not shown). In an exemplary embodiment, the vapor compression system may be a vehicle air conditioning system known to those skilled in the art for cooling the passenger compartment of a vehicle. Condenser system 20 includes a condenser, generally designated 22, and a receiver portion, generally designated 24. Condenser 20 includes a pair of tubular, parallel headers, generally designated as a first header 26 and a second header 27. Parallel tubes 28 extend between first and second headers 26 and 27, respectively, for passing refrigerant between first and second headers 26 and 27. Receiver portion 24 includes a pipe assembly, generally designated 30, and a receiver dryer 32. Pipe assembly 30 includes an inlet pipe 34, an outlet pipe 36, and a mounting bracket 38.

In an exemplary embodiment, condenser 22 is a three pass condenser. As such, first header 26 includes imperforate walls 40 and 42 extending through first header 26. Similarly, second header 27 includes an imperforate wall 44 extending through second header 27. First header 26 includes an inlet opening 46 for receiving a mixture of vapor and liquid phase refrigerant from a compressor (not shown) of the vehicle air conditioning system (not shown). Below imperforate wall 44, second header 27 includes an outlet opening 48 for directing liquid phase refrigerant from condenser 22 toward the evaporator (not shown) of the vehicle air conditioning system.

Figure 2:
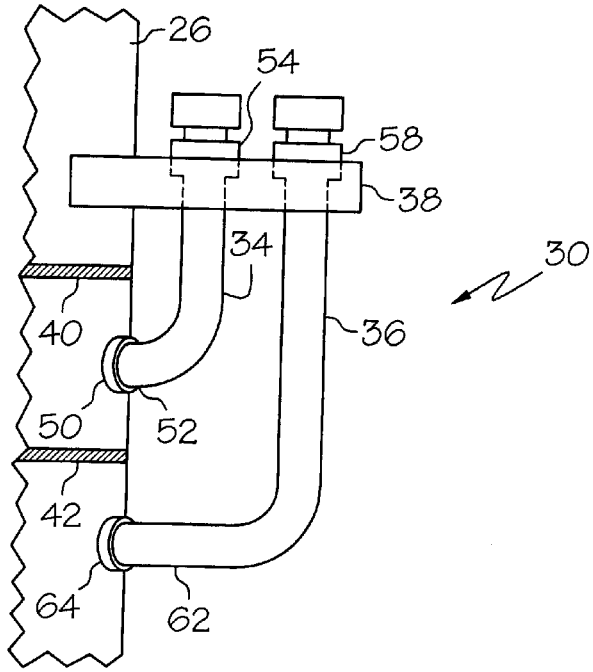
FIG. 2 shows a top view of a pipe assembly coupled to a first header of the condenser system of FIG. 1.
Figure 3:
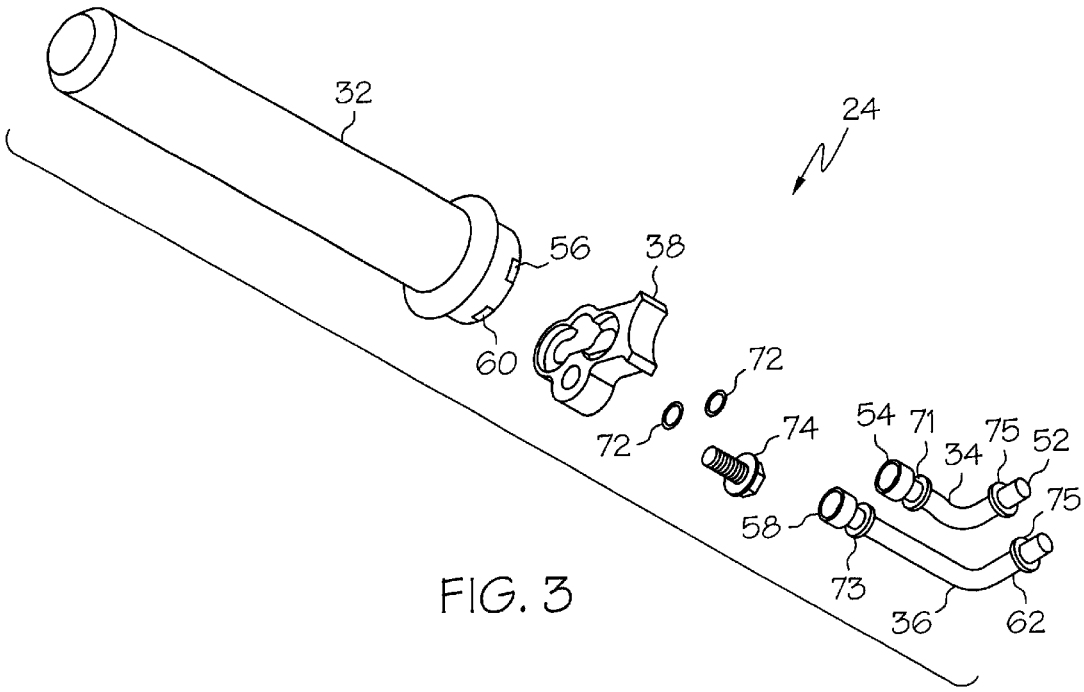
FIG. 3 shows an exploded perspective view of a receiver portion of the condenser system of FIG. 1.

Referring to FIGS. 2–3 in connection with FIG. 1, FIG. 2 shows a top view of pipe assembly 30 coupled to first header 26 of condenser system 20. FIG. 3 shows an exploded perspective view of receiver portion 24 of condenser system 20. As shown, between imperforate walls 40 and 42, first header 26 includes an outlet 50 to which a header attachment end 52 of inlet pipe 34 couples. An outlet end 54 of inlet pipe 34 couples to an inlet port 56 of receiver dryer 32. An inlet end 58 of outlet pipe 36 couples to an outlet port 60 of receiver dryer 32, and an header attachment end 62 of outlet pipe 36 couples to an inlet 64 of first header 26 below imperforate wall 42.

In general, vapor and liquid phase refrigerant enters condenser system 20 at inlet 46 of first header 26. The refrigerant may be distributed by first header 26 to tubes 28 that are above imperforate wall 40, referred to generally as a first upstream section 66, to flow to second header 27. Once the refrigerant enters second header 27, it is distributed to tubes 28 that are above imperforate walls 42 and 44, and below imperforate wall 40, referred to generally as a second upstream section 68, to flow to first header 26. At first header 26, the vapor and liquid phase refrigerant is routed to receiver dryer 32 via inlet pipe 34.

Receiver dryer 32 may include a desiccant (not shown). The desiccant tends to absorb any water that is mixed with the refrigerant. Receiver dryer 32 further serves to separate the liquid phase refrigerant from the vapor phase refrigerant. After the liquid phase refrigerant and the vapor phase refrigerant are separated within receiver dryer 32, liquid refrigerant is subsequently routed to tubes 28 below imperforate walls 42 and 44, referred to generally as a downstream section 70, via outlet pipe 36.

Downstream section 70, known as a sub-cooler section, of condenser system 20 sub-cools the liquid refrigerant to a point below the temperature at which the liquid changes to a gas. The sub-cooled liquid phase refrigerant increases the ability of the evaporator (not shown) of the vehicle air conditioning system to absorb heat as the refrigerant evaporates, thus improving the efficiency of the system. Following sub-cooling in downstream section 70, the liquid refrigerant passes to second header 27 below imperforate wall 44 and exits from outlet opening 48 for eventual receipt at the evaporator (not shown) of the vehicle air conditioning system (not shown).

FIG. 3 further shows bracket 38 interposed between receiver dryer 32 and inlet and outlet pipes 34 and 36, respectively. An O-ring 72 is positioned between outlet end 54 of inlet pipe 34 and bracket 38. Similarly, another O-ring 72 is positioned between and inlet end 58 of outlet pipe 36 and bracket 38. In addition, inlet pipe 34 includes a first flange 71 extending radially from outlet end 54, and outlet pipe 36 includes a second flange 73 extending radially from inlet end 58. Stop beads 75 extend radially from header attachment end 52 of inlet pipe 34 and from header attachment end 62 of outlet pipe 36. A fastener 74 is directed through bracket 38 to enable the connection of receiver dryer 32 to bracket 38.

As will be described in greater detail below, bracket 38 advantageously facilitates the pre-assembly of pipe assembly 30 prior to furnace brazing condenser system 20. In particular bracket 38 retains inlet and outlet pipes 34 and 36, respectively, in fixed relation with first header 26 without the need for additional fixtures. Following the brazing process, receiver dryer 32 is simply bolted to bracket 38 using fastener 72.

Condenser system 20 is described as being a three pass condenser having an integral sub-cooling section for simplicity of illustration. However, the invention does not require that the condenser system be a three pass condenser. Rather, the number of passes will vary as dictated by the requirements of a particular system. Nor does the invention require that the condenser system be used solely in vehicle air conditioning systems. Rather, the present invention may be implemented in a number of vapor compression systems that employ a receiver dryer unit known to those skilled in the art.

Figure 4:
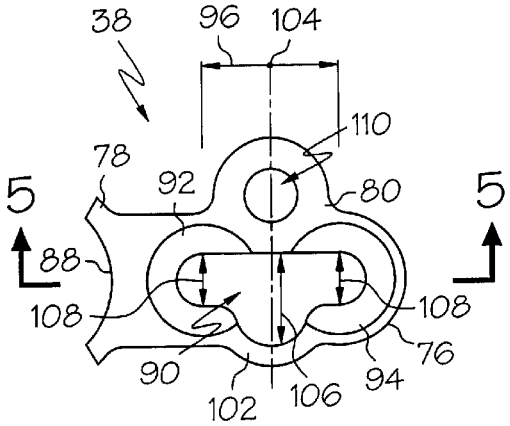
FIG. 4 shows a front view of a receiver dryer mounting bracket in accordance with a preferred embodiment of the present invention.
Figure 6:
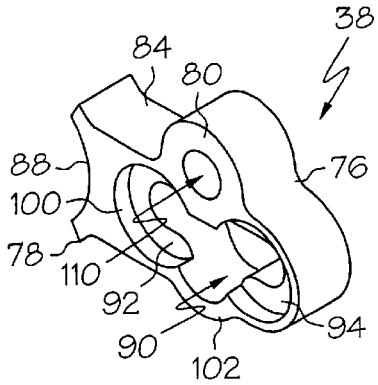
FIG. 6 shows a perspective view of the mounting bracket of FIG. 4.
Figure 5:
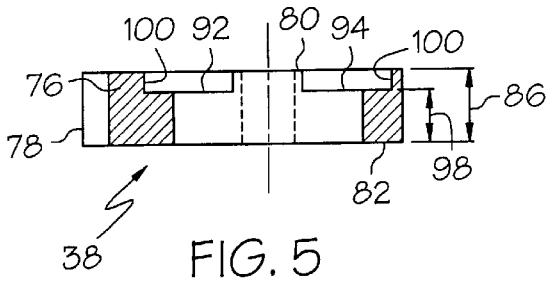
FIG. 5 shows a section view of the mounting bracket of FIG. 3 taken along section line 4—4.

Referring to FIGS. 4–6, FIG. 4 shows a front view of receiver dryer mounting bracket 38 in accordance with a preferred embodiment of the present invention. FIG. 5 shows a section view of the mounting bracket 38 taken along section line 5—5 of FIG. 4. FIG. 6 shows a perspective view of mounting bracket 38.

Receiver dryer mounting bracket 38 includes a body 76 and an arm 78 coupled to and extending from body 76. More specifically, body 76 includes a first surface 80, a second surface 82, and a side 84 spanning a first width 86 of body 76 from first surface 80 to second surface 82. Body 76 and arm 78 of bracket 38 are fabricated as a single contiguous unit by milling, extrusion, or other manufacturing methods known to those skilled in the art. Arm 78 extends from side 84 of body 76 and includes a concave surface 88 for mating engagement with first header 26 (FIG. 2).

An opening 90 extends through body 76. Opening 90 is generally oblong in shape. A first seat section 92 and a second seat section 94 are positioned at opposing ends of a length 96 of opening 90. Body 76 at each of first and second seat sections 92 and 94 exhibits a second width 98. Second width 98 is less than first width 86 such that a side wall 100 is formed at each of first and second seat sections 92 and 94, respectively.

Body 76 further includes an arcuate crimp section 102 extending from side 84 of body 76. Arcuate crimp section 102 is approximately aligned with a mid-point 104 of length 96 of oblong opening 90. Thus, arcuate crimp section 102 causes a mid-section span 106 of oblong opening 90 to be wider than an end-section span 108 of oblong opening 90 at each of first and second seat sections 92 and 94, respectively. Body 76 also has an attachment hole 110 for passage of fastener 74 (FIG. 3) employed to couple receiver dryer 32 (FIG. 3) to bracket 38.

Figure 7:
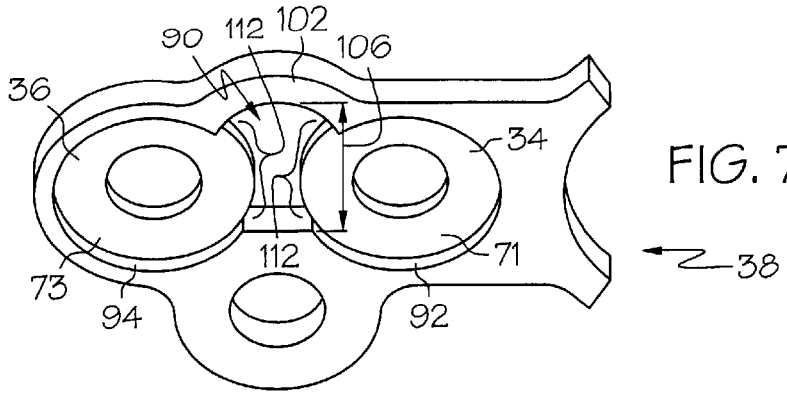
FIG. 7 shows a perspective view of the mounting bracket of FIG. 4 with inlet and outlet pipes positioned therein.
Figure 8:
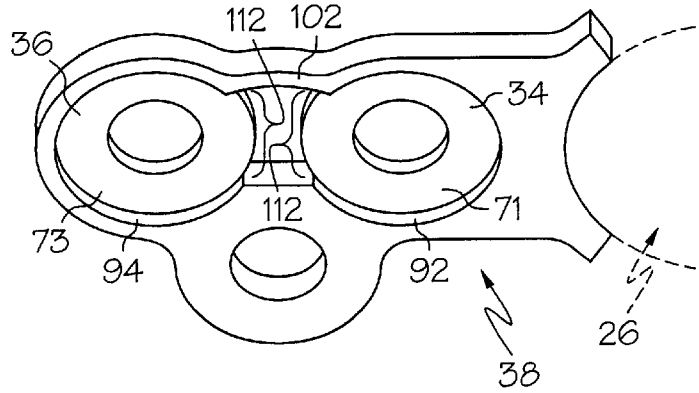
FIG. 8 shows a perspective view of the mounting bracket shown in FIG. 7 with an arcuate crimp section of the mounting bracket compressed.

FIG. 7 shows a perspective view of mounting bracket 38 with inlet and outlet pipes 34 and 36 positioned therein. FIG. 8 shows a perspective view of mounting bracket 38 with arcuate crimp section 102 of bracket 38 compressed. A method of securing receiver dryer 32 (FIG. 1) to condenser 22 (FIG. 1) entails directing inlet pipe 34 through mid-section span 106 of oblong opening 90, and moving inlet pipe 34 laterally to seat first flange 71 of inlet pipe 34 in first seat section 92. Similarly, outlet pipe 36 is directed through mid-section span 106 and moved laterally to seat second flange 73 of outlet pipe 36 in second seat section 94.

A gap 112 at each of first and second seat sections 92 and 94 is sized to accommodate the outer diameter of each of inlet and outlet pipes 34 and 36, respectively, in order to move inlet and outlet pipes 34 and 36 into first and second seat sections 92 and 94. In addition, first and second seat sections 92 and 94 are configured to enable each of first and second flanges 71 and 73 to reside within respective ones of first and second seat sections 92 and 94, surrounded in part by side wall 100 (FIG. 5).

Once first and second flanges 71 and 73 of inlet and outlet pipes 34 and 36 are seated in respective ones of first and second seat sections 92 and 94, respectively, arcuate crimp section 102 is compressed to secure inlet and outlet pipes 34 and 36 in first and second seat sections 92 and 94 (as shown in FIG. 8). Once arcuate crimp section 102 is compressed, gap 112 decreases so that inlet and outlet pipes 34 and 36 are prevented from moving out of first and second seat sections 92 and 94. Thus, pipe assembly 30 (FIG. 2) is formed.

Following the fabrication of pipe assembly 30, header attachment end 52 (FIG. 2) of inlet pipe 34 is positioned in outlet 50 (FIG. 2) of first header 26 until its stop bead 75 (FIG. 3) touches first header 26. Concurrently, header attachment end 62 of outlet pipe 36 is positioned in inlet 64 (FIG. 2) of first header 26 until its stop bead 75 touches first header 26.

The retention of first and second flanges 71 and 73 in first and second seat sections 92 and 94, respectively, provides positive location and alignment of outlet end 54 (FIG. 2) of inlet pipe 34 and inlet end 58 of outlet pipe 36 with mating inlet and outlet ports 56 and 60, respectively, (FIG. 3) on receiver dryer 32, as well as with outlet 50 and inlet 64 on first header 26. This positive location and alignment substantially promotes the correct connection of receiver portion 24 (FIG. 1) to condenser 22.

Concave surface 88 (FIG. 4) of arm 78 is readily tack welded to first header 26, shown in ghost form in FIG. 8, to attach pipe assembly 30 (FIG. 2) to condenser 22 (FIG. 1). Condenser 22 (FIG. 1) with attached pipe assembly 30 is subsequently passed through a brazing furnace (not shown) to braze, or fuse, pipe assembly 30 to first header 26.

Following the brazing process, outlet end 54 (FIG. 2) of inlet pipe 34 is coupled to inlet port 56 (FIG. 3) of receiver dryer 32 (FIG. 3), and inlet end 58 of outlet pipe 36 is coupled to outlet port 60 (FIG. 3) of receiver dryer 32. Fastener 74 (FIG. 3) is then used to fasten receiver dryer 32 to body 76 of bracket 38 to secure receiver dryer 32 to condenser 22.

Figure 9:
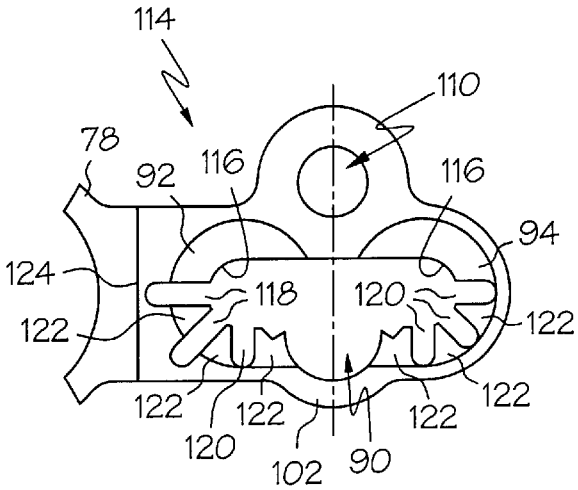
FIG. 9 shows a front view of a receiver dryer mounting bracket in accordance with a second preferred embodiment of the present invention.
Figure 10:
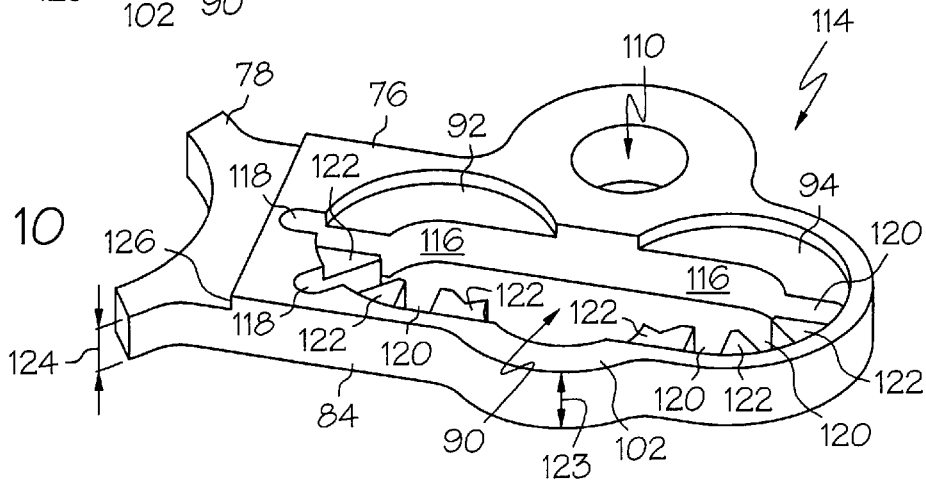
FIG. 10 shows a perspective view of the receiver dryer mounting bracket of FIG. 9.

Referring to FIGS. 9–10, FIG. 9 shows a front view of a receiver dryer mounting bracket 114 in accordance with a second preferred embodiment of the present invention. FIG. 10 shows a perspective view of receiver dryer mounting bracket 114.

Receiver dryer mounting bracket 114 is similar to mounting bracket 38. That is, mounting bracket 114 includes body 76 and arm 78 coupled to and extending from side 84 of body 76. Mounting bracket 114 further includes oblong opening 90, first and second seat sections 92 and 94, respectively, at opposing ends of oblong opening 90, arcuate crimp section 102, and attachment hole 110 for accommodating fastener 74 (FIG. 3).

An inner edge 116 of each of first and second seat, sections 92 and 94, respectively, delineates a portion of oblong opening 90. Body 76 of mounting bracket 114 has first bend relief slots 118 and second bend relief slots 120 extending through body 76 and radiating outwardly from inner edge 116. First bend relief slots 118 of first seat section 92, located proximate arm 78, are longer than second bend relief slots 120. More specifically, the length, or depth, of first bend relief slots 118 are approximately one and a half to twice the length of second bend relief slots 120.

The region of mounting bracket 114 about first seat section 92 has more mass than the region of mounting bracket 114 closest to second seat section 94. This additional mass at first seat section 92 causes that region of mounting bracket 114 to be more rigid than the region of mounting bracket 114 proximate second seat section 94. The length, i.e., depth, of first and second bend relief slots 118 and 120 has evolved through trial and error and establishes an optimal depth for substantially equivalent compression of oblong opening 90 at each of first and second seat sections 92 and 94. The increased length of first bend relief slots 118 relative to second bend relief slots 120 allows first seat section 92 to compress, or close, at a ratio close to second seat section 94.

When assembling pipe assembly 30 (FIG. 2) using mounting bracket 114 in place of mounting bracket 38 (FIG. 4), as arcuate crimp section 102 is compressed, first and second bend relief slots 118 and 120 close, so that fingers 122 separating first and second bend relief slots 118 and 120 wrap around inlet and outlet pipes 34 and 36. In the same motion, fingers 122 lightly embed into the outer wall of inlet and outlet pipes 34 and 36 to hold pipe assembly 30 (FIG. 2) together while still allowing inlet and outlet pipes 34 and 36 to move axially to absorb the various mating part tolerances as pipe assembly 30 is attached to first header 26 (FIG. 1). Thus, the length of first and second bend relief slots 118 and 120 and the positioning of fingers 122 control the interference between mounting bracket 114 and inlet and outlet pipes 34 and 36, while maintaining the orientation of pipes 34 and 36.

Body 76 of receiver dryer mounting bracket 114 exhibits a width 123, and arm 78 of bracket 114 exhibits an arm width 124. Arm width 124 is less than width 123 such that a step 126 is formed between body 76 and arm 78. Step 126 helps prevent flux from wicking (i.e., flowing or migrating) toward inlet and outlet pipes 34 and 36, respectively, during the furnace brazing process. Thus, step 126 controls a post braze condition of inlet and outlet pipes 34 and 36. Although step 126 is illustrated on mounting bracket 114, it should be understood that mounting bracket 38 (FIG. 4) and mounting brackets described in connection with FIGS. 11–12 may be adapted to include step 124.

Figure 11:
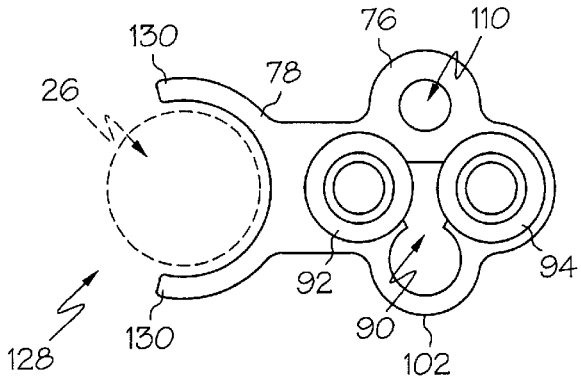
FIG. 11 shows a front view of a receiver dryer mounting bracket in accordance with an alternative embodiment of the present invention.

FIG. 11 shows a front view of a receiver dryer mounting bracket 128 in accordance with an alternative embodiment of the present invention. Receiver dryer mounting bracket 128 is similar to mounting brackets 38 (FIG. 4) and 114 (FIG. 9). That is, mounting bracket 128 includes body 76, arm 78, oblong opening 90 extending through body 76, first and second seat sections 92 and 94, respectively, at opposing ends of oblong opening 90, arcuate crimp section 102, and attachment hole 110 for accommodating fastener 74 (FIG. 3).

However, arm 78 of mounting bracket 128 further includes extension portions 130, each of which extend symmetrically about a central axis with respect to the other of extension portions 130. Extension portions 130 are configured to enable a snap fit of arm 78 about first header 26, shown in ghost form, thereby eliminating the need for the tack weld, discussed above, prior to the furnace brazing process. The snap fit simplifies system assembly, thus reducing the labor costs associated with system assembly. Although extension portions 130 are illustrated on mounting bracket 128, it should be understood that any of the mounting brackets described herein may be adapted to include extension portions 130.

Figure 12:
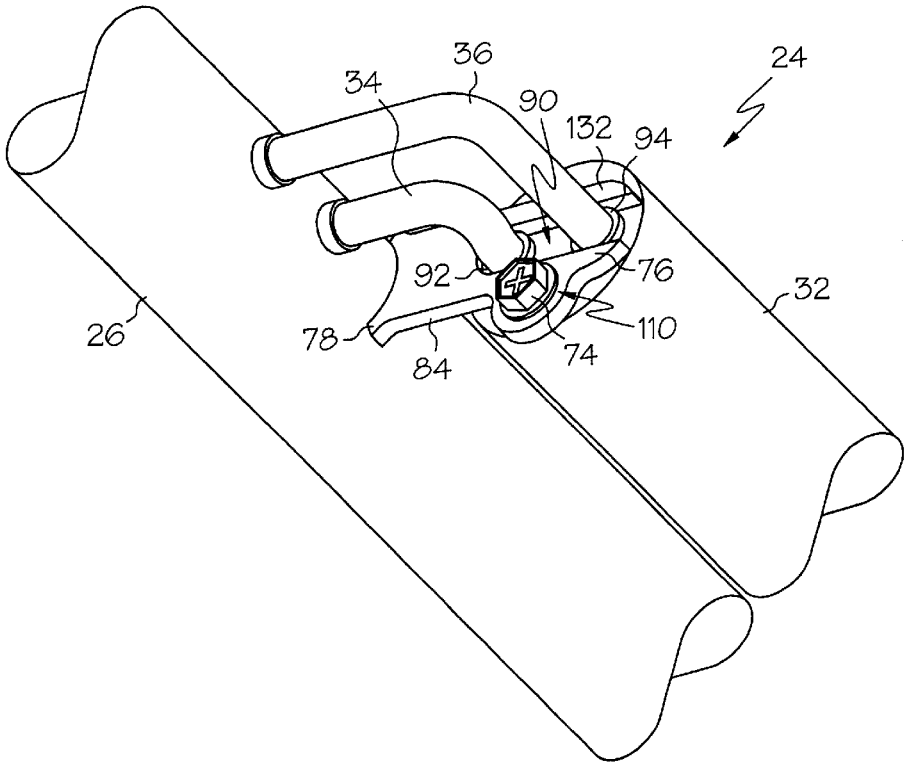
FIG. 12 shows a partial perspective view of a receiver portion of the condenser system of FIG. 1 that employs a receiver dryer mounting bracket in accordance with another alternative embodiment of the present invention.

FIG. 12 shows a partial perspective view of receiver portion 24 of the condenser system 20 (FIG. 1) that employs a receiver dryer mounting bracket 132 in accordance with another alternative embodiment of the present invention. Receiver dryer mounting bracket 132 includes body 76 and arm 78 coupled to and extending from side 84 of body 76. Mounting bracket 132 further includes oblong opening 90, first and second seat sections 92 and 94, respectively, at opposing ends of oblong opening 90, and attachment hole 110 for accommodating fastener 74.

However, mounting bracket 132 does not include arcuate crimp section 102 (FIG. 4), discussed extensively above. Rather, oblong opening 90 of mounting bracket 132 extends through side 84 proximate second seat section 94. As such, a slot is formed through which inlet and outlet pipes 34 and 36, respectively, are passed for positioning into respective ones of first and second seat sections 92 and 94.

In summary, the present invention teaches of a receiver dryer mounting bracket for a condenser system. The retention of the inlet and outlet pipes in the mounting bracket provides positive location and alignment of the inlet and outlet pipes with the receiver dryer, as well as with the condenser header. This positive location and alignment promotes the correct connection of the receiver portion to the condenser header. In addition, the mounting bracket provides a self-fixturing subassembly using, at most, a single tack weld and no additional fixtures to secure the assembly to the condenser header prior to furnace brazing. Following brazing, the bracket provides a secure mount for the receiver dryer via a through-hole for a single fastener connection. The single fastener connection of the receiver dryer to the mounting bracket enables rapid and simple servicing of the receiver dryer, while decreasing the potential for damaging the inlet and outlet pipes, and/or the condenser.

Although the preferred embodiments of the invention have been illustrated and described in detail, it will be readily apparent to those skilled in the art that various modifications may be made therein without departing from the spirit of the invention or from the scope of the appended claims. For example, it should be readily apparent that the present invention may be adapted to retain a pair of pipes in fixed relation with a mounting surface, other than inlet and outlet pipes of a sub-cooled condenser system.

What is claimed is:

1. In a condenser system having two spaced apart headers, a plurality of parallel tubes extending between said headers for passing refrigerant between said headers, a receiver dryer, and a pipe coupled to one of said headers and a port of said receiver dryer, a bracket for retaining said pipe in fixed relation with said one of said headers, said bracket comprising:

a body having an opening extending through a width of said body, said opening being configured for passage of said pipe, said body having a seat section at said opening configured for retention of said pipe; and an arm coupled to and extending from said body, said arm having a surface for mating engagement with said one of said headers.

2. A bracket as claimed in claim 1 wherein said pipe includes a flange, and seat section is configured to enable said flange to reside within said seat section.

3. A bracket as claimed in claim 2 wherein said width of said body is a first width, and said body at said seat section exhibits a second width, said second width being less than said first width such that a side wall is formed at said seat section for surrounding said flange.

4. A bracket as claimed in claim 1 wherein said opening is an oblong opening and said seat section is at a first position along of a length of said oblong opening.

5. A bracket as claimed in claim 4 wherein said body includes a crimp section located at a second position along said length of said oblong opening, and crimping of said crimp section causes said pipe to be secured in said seat section.

6. A bracket as claimed in claim 5 wherein said crimp section causes a first span of said oblong opening to be wider at said second position than a second span of said oblong opening at said seat section.

7. A bracket as claimed in claim 5 wherein said pipe is a first pipe, said seat section is a first seat section, said condenser system includes a second pipe coupled to said one of said headers and a second port of said receiver dryer, and said body further comprises:

a second seat section at a third position along a length of said oblong opening configured for retention of said second pipe, said first and third positions being at opposing ends of said length of said oblong opening, said second position of said crimp section being approximately aligned with a midpoint of said length of said oblong opening, and crimping of said crimp section causes said first and second pipes to be secured in respective ones of said first and second seat sections.

8. A bracket as claimed in claim 4 wherein said oblong opening extends through a side of said body for forming a slot through which said pipe is passed for positioning into said seat section.

9. A bracket as claimed in claim 1 wherein said seat section includes an inner edge, said inner edge delineating a portion of said opening, and said body has bend relief slots extending through said body and radiating outwardly from said inner edge.

10. A bracket as claimed in claim 9 wherein said pipe is a first pipe, said seat section is a first seat section, said condenser system includes a second pipe coupled to said one of said headers and a second port of said receiver dryer, and said body further comprises:

a second seat section at said opening configured for retention of said second pipe, said second seat section being positioned farther away from said arm than said first seat section, said second seat section including said inner edge delineating another portion of said opening, and ones of said bend relief slots at said first seat section are longer than said bend relief slots of said second seat section.

11. A bracket as claimed in claim 1 wherein said body has an attachment hole for passage of a fastener adapted to couple said receiver dryer to said bracket.

12. A bracket as claimed in claim 1 wherein said width of said body is greater than an arm width of said arm to form a step between said body and said arm.

13. A bracket as claimed in claim 1 wherein said arm includes extension portions, each of which extends symmetrically about a central axis with respect to the other of said extension portions for enabling a snap fit of said arm about said one of said headers.

14. A method of securing a receiver dryer to a sub-cooled condenser, said sub-cooled condenser having two spaced apart headers and a plurality of parallel tubes extending between said headers for passing refrigerant between said headers, said method comprising:

providing a bracket including a body having an oblong opening extending through said body, and having a seat section at a first position along a length of said oblong opening, said body further having a crimp section located at a second position along said length of said oblong opening, said crimp section causing a first span of said oblong opening at said second position to be wider than a second span of said oblong opening at said first position, and said bracket further including an arm coupled to and extending from said body, said arm having a concave surface;

directing a pipe through said first span of said oblong opening;

moving said pipe laterally to seat a flange of said pipe in said seat section;

compressing said crimp section to secure said pipe in said seat section to form a pipe assembly;

positioning a header attachment end of said pipe in a corresponding hole in one of said headers;

tack welding said surface of said arm to said one of said headers to attach said pipe assembly to said sub-cooled condenser;

passing said sub-cooled condenser and said attached pipe assembly through a brazing furnace to braze said pipe assembly to said one of said headers;

coupling a receiver attachment end of said pipe with a port of said receiver dryer; and fastening said receiver dryer to said body of said bracket to secure said receiver dryer to said sub-cooled condenser.

15. A method as claimed in claim 14 wherein said pipe is a first pipe, said flange is a first flange, said seat section is a first seat section, and said method further comprises:

directing, prior to said compressing operation, a second pipe through said first span of said oblong opening;

moving, prior to said compressing operation, said second pipe laterally to seat a second flange of said second pipe in a second seat section of said first surface of said body, said compressing operation functioning to secure said first and second pipes in respective ones of said first and second seat sections to form said pipe assembly; and positioning a second header attachment end of said second pipe in a corresponding second hole in said one of said headers; and coupling, following said passing operation, a second receiver attachment end of said second pipe with a second port of said receiver dryer.

16. In a condenser system having two spaced apart headers, a plurality of parallel tubes extending between said headers for passing refrigerant between said headers, a receiver dryer, a pipe coupled to one of said headers and a port of said receiver dryer, and said pipe having a flange, a bracket for retaining said pipe in fixed relation with said one of said headers, said bracket comprising:

a body including an oblong opening extending through a width of said body for passage of said pipe, said body having a seat section at a first position along said oblong opening configured for retention of said flange of said pipe, and said body including a crimp section extending from said body at a second position along said oblong opening, wherein compression of said crimp section causes said pipe to be secured in said seat section; and an arm coupled to and extending from said side of said body, said arm having a surface for mating engagement with said one of said headers.

17. A bracket as claimed in claim 16 wherein said width of said body is a first width, and said body at said seat section exhibits a second width, said second width being less than said first width such that a side wall is formed at said seat section for surrounding said flange.

18. A bracket as claimed in claim 16 wherein said crimp section causes a first span of said oblong opening to be wider at said second position than a second span of said oblong opening at said seat section.

19. A bracket as claimed in claim 16 wherein said seat section includes an inner edge, said inner edge delineating a portion of said opening, and said body has bend relief slots extending through said body and radiating outwardly from said inner edge.

20. A bracket as claimed in claim 19 wherein said pipe is a first pipe, said seat section is a first seat section, said condenser system includes a second pipe coupled to said one of said headers and a second port of said receiver dryer, and said body further comprises:

a second seat section at said oblong opening configured for retention of said second pipe, said second seat section being position farther away from said arm than second first seat section, said second seat section including said inner edge delineating a portion of said opening, and ones of said bend relief slots at said first seat section are longer than said bend relief slots of said second seat section.

* * * * *